US005567143A

United States Patent [19]

Servidio

[11] Patent Number: 5,567,143

[45] Date of Patent: Oct. 22, 1996

[54] FLUE DRAFT MALFUNCTION DETECTOR AND SHUT-OFF CONTROL FOR OIL BURNER FURNACES

[76] Inventor: Patrick F. Servidio, 12 Thistle La., Greenwich, Conn. 06831

[21] Appl. No.: 499,569

[22] Filed: Jul. 7, 1995

[51] Int. Cl.[6] ..... F23N 5/10; H01H 37/76

[52] U.S. Cl. ..... 431/22; 431/16; 110/190; 337/404

[58] Field of Search ..... 110/162, 163, 110/147, 190; 431/22, 16; 337/404, 401

[56] References Cited

U.S. PATENT DOCUMENTS

| | | | |
|---|---|---|---|
| 2,130,175 | 9/1938 | Betz et al. | 431/22 |
| 3,304,396 | 2/1967 | Hasson | 337/401 |
| 3,740,688 | 6/1973 | McIntosh et al. | 337/407 |
| 4,089,632 | 5/1978 | Rexroad | 431/21 |
| 4,204,833 | 5/1980 | Kmetz et al. | 431/22 |
| 4,281,309 | 7/1981 | Olson | 337/409 |

*Primary Examiner*—F. Daniel Lopez
*Assistant Examiner*—Michael S. Lee
*Attorney, Agent, or Firm*—Parmelee, Bollinger & Bramblett; G. Kendall Parmelee

[57] ABSTRACT

Flue-draft-malfunction detector and shut-off control for oil burner furnaces automatically stops operation of the oil burner in event of flue draft malfunction and prevents further running operation of the oil burner until a meltable element in the control is replaced by an intact element. The control casing has a passageway with an inlet on its front end and at least one outlet. The control is mountable on a furnace with the inlet communicating with the furnace combustion chamber. The meltable element is removably positioned within the casing for exposure to the passageway. Two electrical conductors extend from opposite ends of the element and serve as leads connectable in circuit across two terminals of a primary oil burner control so the element completes a circuit between these terminals. Flue draft malfunction causes positive pressure in the combustion chamber during running of the burner, thereby forcing hot combustion gasses to flow from the combustion chamber through the passageway and out into ambient air. The element does not melt from a start-up puff but will melt from persisting flow of hot gases flowing through the passageway exceeding a predetermined temperature level, thereby interrupting the circuit for immediately stopping the burner. Since the melted open-circuit element advantageously prevents restarting continuing normal running operation of a burner in a furnace having a malfunctioning flue draft, a mechanic will be called who will fix the flue draft and replace the melted element for enabling restarting normal burner operation.

20 Claims, 8 Drawing Sheets

FLUE DRAFT MALFUNCTION DETECTOR AND SHUT-OFF CONTROL FOR OIL BURNER FURNACES

FIELD OF THE INVENTION

The present invention is in the field of oil burner control systems and more particularly relates to a flue-draft-malfunction detector and shut-off control for oil burner furnaces.

BACKGROUND OF THE INVENTION

An oil burner furnace has a combustion chamber which conventionally is connected through a smoke pipe to a chimney flue passage. During normal operation of the furnace hot combustion gases arising from combustion in the chamber flow out of the chamber through the smoke pipe into the chimney flue. These hot gases are slightly buoyant relative to ambient atmosphere. Thus, they rise up through the flue passage and exit from the top of the chimney. Upward flow of hot combustion gases through a chimney flue passage accompanied by flow of these hot gases through the smoke pipe is called a "flue draft". Flue draft normally exerts a slight suction action on a combustion chamber. Such suction action during normal operation of an oil burner produces a desired slightly reduced pressure, i.e., a sub-atmospheric pressure, within a combustion chamber relative to ambient pressure outside of the furnace.

This normal slightly sub-atmospheric operating pressure within a combustion chamber is called a "negative pressure". In summary, for providing good combustion conditions it is normal and desired for the combustion chamber of a conventional home heating oil burner furnace to be operating at a "negative pressure" due to an appropriate "flue draft".

There are occurrences which may interfere with, or interrupt, or impede a normal flow of hot combustion gases through a smoke pipe and up a chimney flue passage. In other words, occasions may arise when a flue draft becomes reduced or blocked. A reduced or blocked flue draft which is sufficiently abnormal so as to cause poor combustion with resultant smoke and oily soot becoming forced out of the combustion chamber by abnormal persisting positive pressure so as to enter into living space in a building is called a flue draft "malfunction". Such malfunction can be caused by a variety of adverse factors, such as: a clogged chimney flue passage, a severely rusted perforated smoke pipe, a broken open connection in a smoke pipe, a smoke pipe falling detached from a furnace outlet or detached from a chimney, or a draft-regulator valve disc falling from its pivot, thereby leaving a wide-open smoke-pipe Tee, etc.

A clogged chimney flue passage can result from deterioration of a flue tile such that broken tile pieces fall down from time to time within the flue passage. These accumulating tile pieces can pile up within a flue passage so as to impede or block the flow of hot combustion gases from the smoke pipe into the flue passage. The occupants of a house may be away on vacation during part of a winter and may not be aware of a flue draft malfunction due to deterioration or clogging of a smoke pipe or flue. Or the occupants may have a very busy schedule and not have an opportunity to notice malfunction of a flue draft caused by occurrences of an adverse factor or factors.

As will be explained, problems can arise from malfunction of a flue draft. Interference with, or interruption of, or impedance preventing normal flow of hot combustion gases through the smoke pipe and up the chimney flue passage prevents establishment of a normal flue draft suction action, thereby causing loss of desired negative pressure in the combustion chamber. When malfunction of a flue draft has occurred the usual negative pressure is replaced by an abnormal positive pressure. This abnormal positive pressure results from the fact that an oil burner blower pumps air into the combustion chamber. During flue draft malfunction the blower creates a positive pressure, sometimes called a "back pressure", in the combustion chamber.

This abnormal positive pressure in the combustion chamber causes hot smoky and oily sooty combustion gases to seek exits from the chamber through every available opening and crack. One such exit is through an inspection opening (peep hole) in a furnace inspection door.

As noted above, combustion under conditions of abnormal positive pressure (back pressure) becomes very smoky and sooty. Oily soot and smoke exiting from a positively pressurized combustion chamber can flood throughout a house resulting in serious oily smoke/soot damage. Moreover, in addition to creation of smoke/soot damage, the poor combustion produces excessive amounts of carbon monoxide which may escape from the combustion chamber along with the smoke and soot. Also, build-up of oily soot in and around a furnace, its smoke pipe and flue can become a potential fire hazard.

A conventional optical-type oil burner safety control will not shut off an oil burner when there is malfunction of a flue draft which is causing positive (back) pressure and smoky, sooty combustion in a combustion chamber. Conventionally, an optical sensor is utilized for sensing light from a combustion flame. If a flame fails to ignite within a predetermined time interval after an oil burner is turned on, for example an interval of about 40 to about 45 seconds, then the optical-type control will de-energize the oil burner to turn it off. However, if a flame commences within the predetermined time interval, a conventional optical-type control will allow the burner to continue firing regardless of whether the flame is sooty or normal. Consequently, an optical sensor will allow a badly sooting combustion condition to continue uninterrupted so long as a house thermostat or other temperature sensor is calling for heat to be provided by the oil-fired furnace.

SUMMARY

It is an object of the present invention to overcome or substantially reduce problems which can arise from continuing operation of an oil burner furnace when its combustion chamber is operating at a significant positive pressure.

It is a further object of the present invention to de-energize an oil burner to turn it off when the combustion chamber is operating at a significant positive pressure and remains at such positive pressure for a sufficient period of time to cause a temperature adjacent a peep hole to rise above a predetermined safe level.

It is another object of the present invention to provide an automatic shut-off control for shutting off an oil burner upon detection of draft malfunction and wherein, subsequent to such automatic shut-off, the oil burner cannot be restarted to run by a home owner because a critical meltable element in the control itself needs to be replaced by a mechanic before the oil burner can be restarted. Thus, the home owner, upon discovering that the oil burner is not operating, and cannot be restarted to run in continuing normal operation by pressing a reset button, will call a mechanic. The mechanic will see that the oil burner was automatically shut down by a melted element due to draft malfunction. The mechanic will correct the draft malfunction and will replace the critical element before restarting normal operation of the oil burner.

In accord with the present invention in one embodiment thereof a flue-draft-malfunction detector and shut-off control for stopping operation of an oil burner in event of draft malfunction includes mounting means having a passageway therein with an inlet into the passageway and at least one outlet from the passageway. The mounting means is mountable on an oil burner furnace with the inlet being in communication with a combustion chamber within the furnace and with the outlet being in communication with ambient air near the furnace. There is a meltable, electrically-conductive element having first and second terminals with first and second electrical leads connected to the first and second terminals. The control further includes holding means for the meltable element for positioning the element exposed to the passageway. This element is meltable at a temperature in the passageway exceeding a predetermined level due to positive pressure within the combustion chamber causing hot combustion gases to blow from the combustion chamber through the passageway and out the outlet. The first and second electrical leads are connectable in circuit with a control device for the oil burner for completing a circuit between terminals of the control device for enabling operation of the oil burner and for preventing operation of the oil burner upon interruption of the circuit resulting from melting of the meltable element.

BRIEF DESCRIPTION OF THE DRAWINGS

The invention, together with further objects, features, advantages and aspects thereof, will be more clearly understood from the following detailed description considered in conjunction with the accompanying drawings which are not drawn to scale with the emphasis instead being placed upon clearly illustrating the principles of the invention. Like reference numerals indicate like elements or like components throughout the different views.

The accompanying drawings, which are incorporated in and constitute a part of the specification, illustrate a presently preferred embodiment of the invention and, together with the general description set forth above and the detailed description of the preferred embodiment set forth below, serve to explain the principles of the invention. In these drawings.

DETAILED DESCRIPTION OF PREFERRED EMBODIMENT

Figure 1:
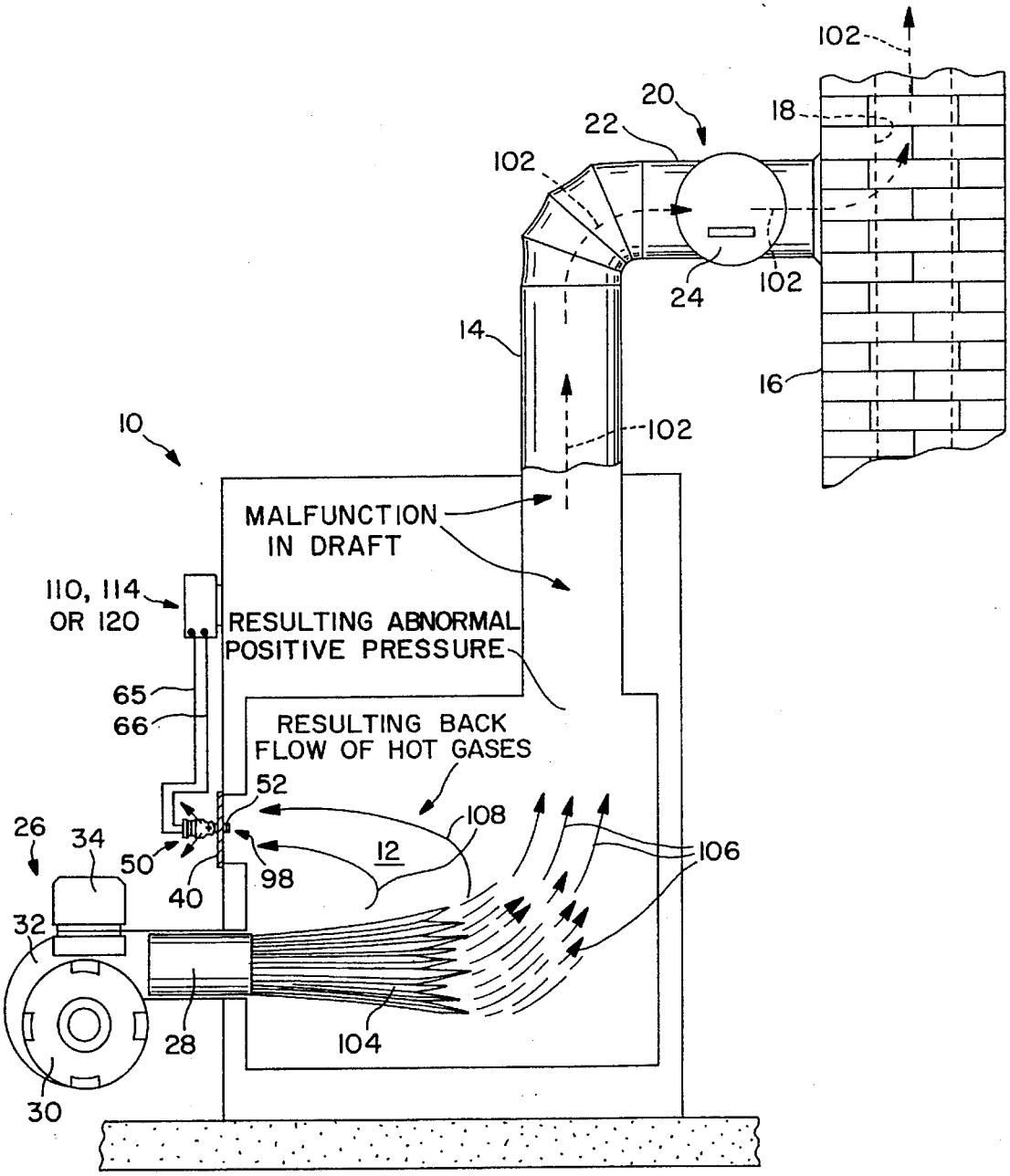
FIG. 1 is a side elevational sectional view of an oil burner furnace having an installed flue-draft-malfunction detector and oil burner shut-off control which embodies the invention. The furnace is connected through a smoke pipe leading to a chimney located to the rear of the furnace. A flue in the chimney is shown in dashed outline.
Figure 2:
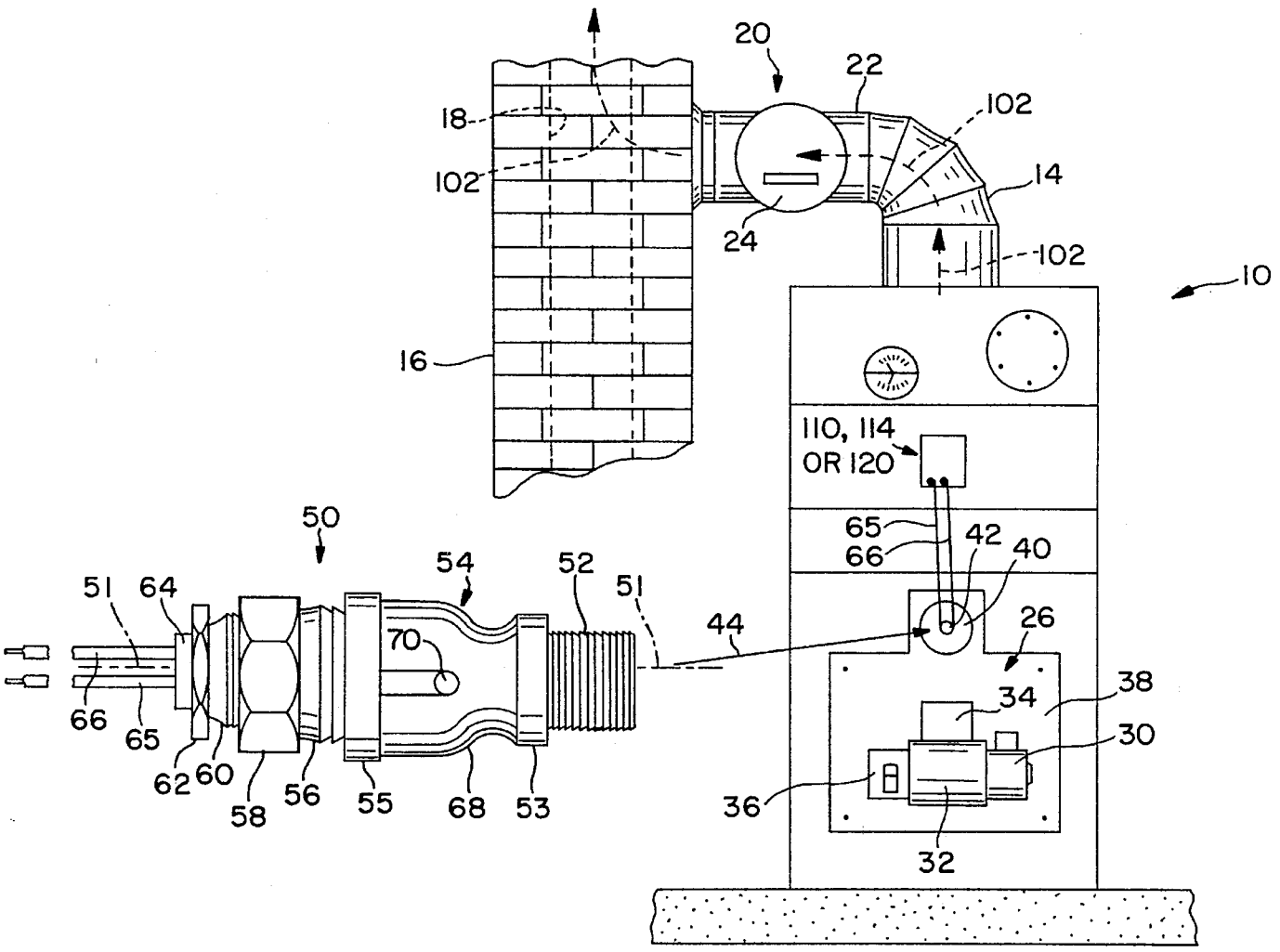
FIG. 2 is a front elevational view of the furnace of FIG. 1 and includes an enlarged side elevational view of the control shown in FIG. 1 and which embodies the invention. An arrow indicates that the control is mountable in a peep hole in an inspection door in the front of the furnace. For clarity of illustrations in FIG. 2 the smoke pipe is shown leading to a chimney at the left of the furnace.

With reference to FIGS. 1 and 2, an oil burner furnace, generally indicated at 10, has a combustion chamber 12 connected through a smoke pipe 14 to a chimney 16 having a flue passage 18. A conventional draft regulator 20 is shown on a Tee section 22 of the smoke pipe. This draft regulator includes a pivoted, counterweighted, diverter-valve disc 24 for regulating the flue draft.

A conventional oil burner 26 has a barrel 28 aimed into the combustion chamber 12. This oil burner is shown including an electric motor 30, a blower 32, an ignition transformer 34 and a fuel pump 36 (FIG. 2). The oil burner is illustrated in FIG. 2 removably supported on the front of the furnace by attachment to a plate 38. Above the oil burner is shown an inspection door 40 having a flame-viewing port (peep hole) 42. As indicated by an arrow 44, a flue-draft-malfunction detector and oil burner shut-off control 50 embodying the present invention is mountable onto the furnace 10. This control 50 has a central axis 51 and is shown having mounting means for example including a forwardly-protruding tubular element in the form of a threaded pipe nipple 52 formed of steel and having a bore extending axially through the nipple. This pipe nipple 52 serves as a heat-resistant, thermally-conductive mounting component. The bore of this tubular element may have a diameter of about ⅜ths of an inch, and it may have a threaded outside diameter of about ½ of an inch.

Figure 4:
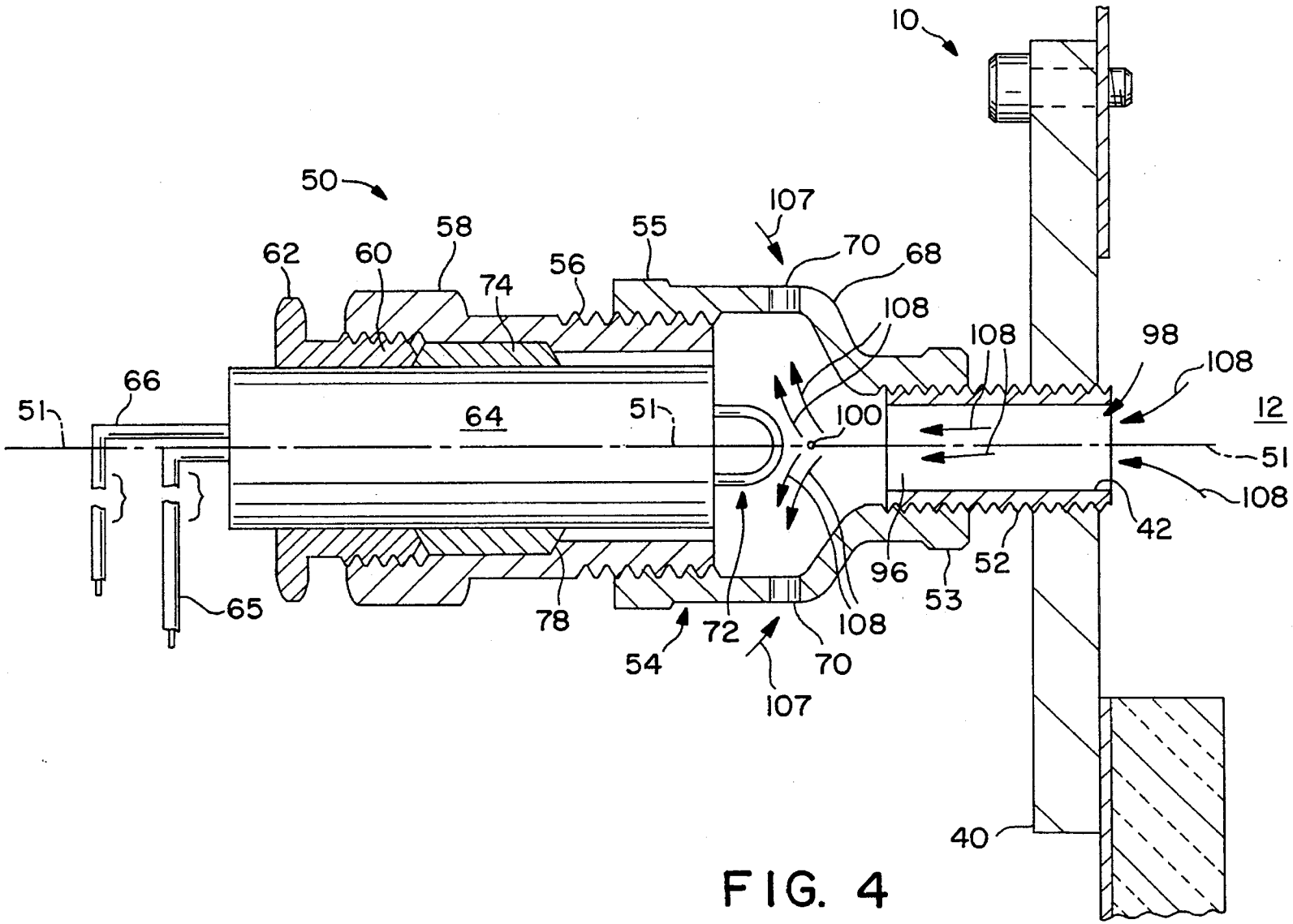
FIG. 4 is an enlarged axial sectional view of the control of FIG. 2 removably mounted in a peep hole (viewing port) opening in an inspection door adjacent to a combustion chamber in a house heating furnace.

To mount the control 50 onto the furnace, the tubular mounting element 52 is preferred to be inserted removably into a peep hole which is enlarged and tapped as shown at 42 in FIG. 4. The control 50 is shown in FIG. 4 mounted, for example by threading tubular element 52 into the enlarged, tapped peep hole 42. Removing the tubular mounting element 52 from the viewing hole 42 enables this enlarged, tapped peep hole to be used in normal manner for inspection of flame status during firing of the oil burner.

The mounting means for the control 50 also includes a component 54 in the form of a hollow member for example shown as a galvanized pipe coupling made of steel and having a smaller forward end 53 and a larger rearward end 55. The hollow member 54 has a passage extending axially therethrough from end 53 to end 55 and serves as a heat-resistant and thermally-conductive casing for the control 50. The tubular element 52 is shown inserted into the smaller forward end 53 which is internally threaded at a diameter of about ½ of an inch for securely receiving the element 52 screwed therein.

The larger rearward end 55 of the casing 54 is internally threaded at a diameter of about ¾ths of an inch for receiving threaded therein a heat-resistant bushing 56, for example shown as a steel bushing, having a hexagonal head 58. This bushing 56 has an axial passage extending therethrough from end to end. Its hex head end 58 is internally threaded at a diameter of about ¾ths of an inch for receiving therein a compression locking nut 60 having a hexagonal head 62. In FIG. 2 protruding from the hex head 62 is seen an end portion of a heat-resistant, electrically-insulative sleeve component 64 having first and second insulated electrical conductors 65 and 66 extending rearwardly therefrom. These two conductors are shown as two insulated leads 65, 66 and they may be provided with a suitable protective sheath.

The casing 54 has a transition shoulder 68 located approximately midway between its smaller and larger ends 53, 55. A plurality of outlet holes (only one is seen at 70) are drilled through the wall of the casing into its interior passage. These outlet holes are located adjacent to the shoulder 68 being offset slightly from the shoulder toward the larger end 55. For example there may be three of these outlet holes uniformly spaced at an angular spacing of 120° around the axis 51. These outlet holes are shown having a diameter of about ⅛th of an inch.

Figure 3:
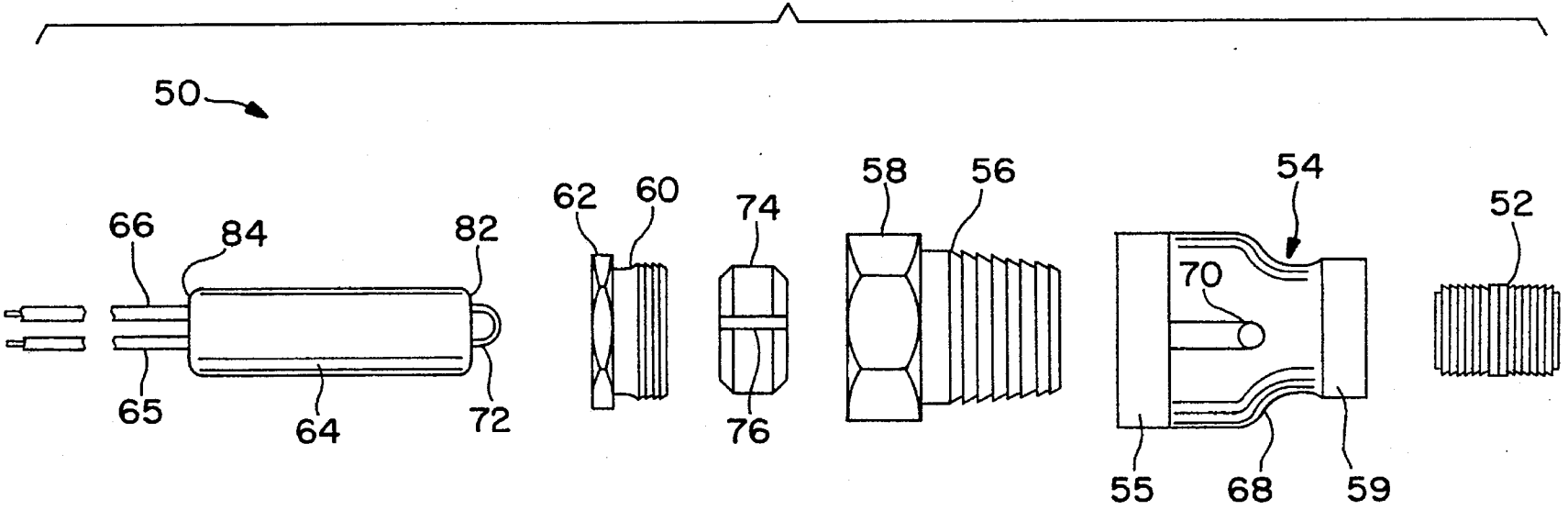
FIG. 3 shows the control of FIG. 2 with its components placed in axial alignment in their appropriate relationship for assembling them.

In FIG. 3 the control 50 of FIG. 2 is shown with its components placed in axial alignment in their appropriate relationship for assembling them. The casing 54 is shown having an axial length for example between about 1⅛ of an inch and about 1⅜ of an inch. The heat-resistant, electrically insulative sleeve component 64 (Please see also FIG. 5.) is shown as a ceramic sleeve having a circular cylindrical exterior with a length for example between about 1½ and about 1¾ inches and an outside diameter between about ½ of an inch and 9/16 of an inch and being made, for example, of porcelain. This sleeve 64 is formed of material of relatively low thermal conductivity and holds a U-shaped, meltable, electrically-conductive element 72 with its U-bend protruding in exposed relationship from a forward end of the sleeve 64, i.e., protruding by an amount between about 3/16 and about 5/16 of an inch, and with conductors 65, 66 extending from a rearward end of the sleeve.

The heat-resistant electrically insulative sleeve component 64 of low thermal conductivity serves as positioning means for holding the U-shaped element 72 (Please see also FIG. 4.) within the casing 54 near the outlet holes 70. As shown this Sleeve extends through the compression locking nut 60 and through a resilient compression ring 74 having an axially extending slit 76 in its wall and through the bushing 64 into the interior of the casing 54, as seen in FIG. 4. The sleeve 64 is held in its position in the control 50 by tightening the compression nut 60 against the compression ring 74 thereby forcing this ring tightly into the bushing 56 against a converging shoulder surface 78 (FIG. 4) for squeezing the ring into firmly encircling embracing relationship around the sleeve. As shown this compression ring 74 is made of a suitable softer material than the compression nut 60 and bushing 56; for example the compression ring is formed of brass.

Figure 5:
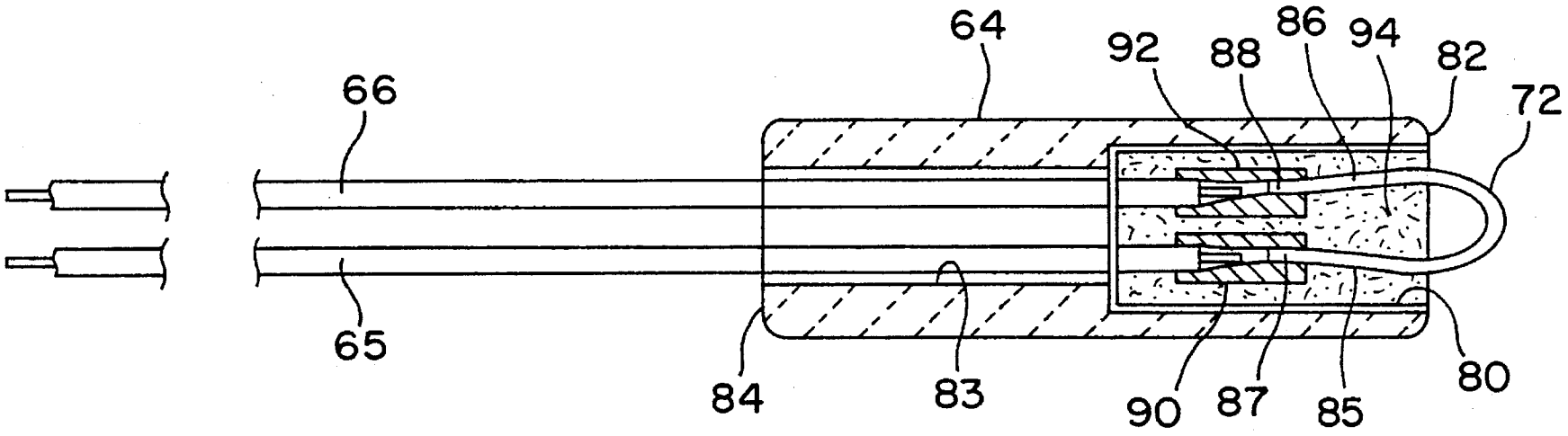
FIG. 5 is an axial sectional view shown enlarged of a high temperature resistive sleeve component having a meltable, electrically-conductive U-bend element protruding from one end with two insulated electrical leads extending from the other end.

With reference to FIG. 5, the sleeve 64 has a circular cylindrical socket 80 extending inward from a front end 82 of the sleeve for a distance about one-half of the overall length of the sleeve. A passage 83 extends rearwardly from this socket 80 to the back end 84 of the sleeve. The U-shaped element 72 has first and second legs 85 and 86 extending rearwardly from its protruding, exposed U-bend. These legs 85, 86 extend rearwardly in generally parallel relationship within the socket 80 to their respective terminal end portions 87, 88. The first and second electrical conductors 65 and 66 may for example be insulated size No. 22 American Wire Gauge (AWG) copper wire connected by respective electrical crimp-on connectors 90 and 92 to the terminal portions 87 and 88 of the U-shaped element 72.

It is desired that the element 72 will melt at a suitable temperature for becoming open-circuited upon occurrence of inappropriate backflow of hot combustion gases through the viewing port 42 caused by flue draft malfunction causing abnormal persisting positive pressure in the combustion chamber. An example of a material which I have found to be suitable for forming the meltable element 72 is an electrically-conductive material melting at a temperature above about 350° F. My experiments to date have shown that rosin-cored solder wire having an outside diameter (O.D.) in the range of about 0.03 of an inch to about 0.05 of an inch and being bent into a U-shape as shown will work to advantage. A rosin-cored solder wire having a composition of about 60% tin and about 40% lead and a diameter of about 0.035 of an inch, about midway within said diameter range, has an advantageous, desirable, operating-melting action in a hot gas temperature range of about 350° F. to about 400° F. depending upon flow rates of hot combustion gases flowing through the control 50, as will be explained later. A faster flow rate results from a greater abnormal positive pressure, i.e., greater "back pressure", within the combustion chamber 12, and such faster flow rate of the hot combustion gases thereby impacting more forcefully against the element 72 causes the element to melt more rapidly at a given gas temperature.

In selecting the material to be used for the U-bent element 72 certain factors are taken into account. One factor is a "start-up puff". Sometimes when an oil burner starts running and when the walls of the combustion chamber are unusually cold, there may be delayed ignition such that a mist of atomized oil collects in the chamber. When ignition occurs there may be a brief interval of sudden smoky combustion with attendant briefly-existent positive pressure in the combustion chamber which may be called a start-up puff. The U-bent element 72 should not be so delicate nor so exposed nor so easily meltable as to become open-circuited by a start-up puff. Another factor is that combustion chambers have different designs such that some inspection doors 40 may normally be operating at considerably higher temperatures than other inspection doors. The U-bent element 72 should not be so delicate nor so exposed nor so easily meltable as to become open-circuited merely by proximity to an unusually hot inspection door 40. A further factor is that flue draft malfunction causes persisting positive pressure in the combustion chamber 12 for as long as the oil burner is running. The U-bent element 72 should be meltable such that no more than about 2½ to 3 minutes of persisting hot gas backflow can occur through the control before the element becomes open-circuited.

In order to hold the crimp-on type connectors 90 and 92 and the legs 85 and 86 of the U-bent element 72 in generally parallel relationship as shown in FIG. 5 within the socket 80, this socket is packed with high-temperature-resistant electrically-insulative fibers (fibres) forming an embedment of low thermal conductivity. Then the fibre-packed socket is filled with an initially-fluid, settable heat-resistant adhesive. The adhesive sets within the socket for embedding the connectors and legs within this heat-resistant and electrically insulative fibre/adhesive mixture 94. A suitable type of fibre is commercially available for the combustion chamber industry as "Kaolwool" from Lynn Products Co. of Lynn, Mass. 01905. A suitable adhesive cement is a specially formulated water-glass composition commercially available as "HOLD TITE" from Utility Manufacturing Company, Inc. of Westbury, N.Y. 11590.

In FIG. 4, the control 50 is seen to have a passageway 96 extending in an axial direction through the tubular mounting element 52 and continuing in an axial direction into the casing 54. Near the U-bend of the meltable element 72 this: passageway 96 branches outwardly in generally radial directions away from the axis 51 and communicates with ambient air through the respective outlets 70. For clarity of illustration two outlets 70 are shown in section in FIG. 4. As explained previously, this embodiment of the invention has three outlets 70 angularly spaced 120° apart around the axis 51.

The protruding U-bend of the meltable element 72 is positioned so as to straddle the axis 51, i.e., the bend extends across the axis, with the convex side of this U-bend facing forwardly along the axis toward an inlet 98 for the passageway 96. This inlet 98 is defined by the bore of the tubular element 52 and is in direct communication with the combustion chamber 12. It is noted that the U-bend of element 72 is positioned adjacent to a region 100 where the passageway 96 branches radially outwardly toward the outlets 70 as is shown by outwardly-directed curved arrows 108 near this region 100.

In normal operation, there is flue draft shown in FIGS. 1 and 2 by dashed arrows 102 which creates a negative pressure within the combustion chamber 12 as explained previously. Thus, in normal operation a combustion flame 104 (FIG. 1) is projected into the chamber 12, and resulting hot combustion gases 106 flow out of the chamber 12 into the flue draft 102. During normal operation, due to the negative pressure (suction action) in the chamber 12 a small quantity of ambient air shown by arrows 107 in FIG. 4 is drawn inwardly through the outlets 70 and is drawn through the passageway 96 and through the inlet 98 into the combustion chamber 12. This inward flow 107 of small amounts of ambient air serves to keep element 72 cool and also serves as a modest amount of secondary air flow for aiding in supporting combustion of the flame 104.

In event of malfunction of the flue draft 102, abnormal persisting positive pressure ("back pressure") occurs in the combustion chamber 12 during running of the oil burner. There is a resulting persisting backflow of the hot combustion gases as is shown by arrows 108 in FIG. 1, because these gases are forced to seek exits from chamber 12 through every available crevice and opening. Hot combustion gases 108 enter the control inlet 98 and blow along the axis 51 directly toward the U-bend of element 72. These hot gases 108 impact against the U-bend and they diverge near the region 100 as shown by curved arrows 108 and they exit through the outlets 70 into ambient air. This impact of persisting hot gases 108 against the element 72 relatively soon melts and open-circuits this element, thereby interrupting a circuit through the leads 65, 66. Interruption of the circuit through leads 65, 66 advantageously serves immediately to shut off operation of the oil burner, as will be explained in connection with FIGS. 6, 7 and 8. A greater abnormal positive pressure in the combustion chamber 12 will cause a more rapid backflow 108 of hot gases through passageway 96. A more rapid backflow 108 will more rapidly melt the element 72, thereby advantageously more quickly shutting off an oil burner furnace which is running under very poor combustion conditions. This rapid shutting off of the oil burner furnace is advantageous since the furnace was generating and discharging into living space considerable amounts of smoky oily soot due to abnormal persisting positive pressure in the combustion chamber caused by malfunction of the flue draft.

Figure 6:
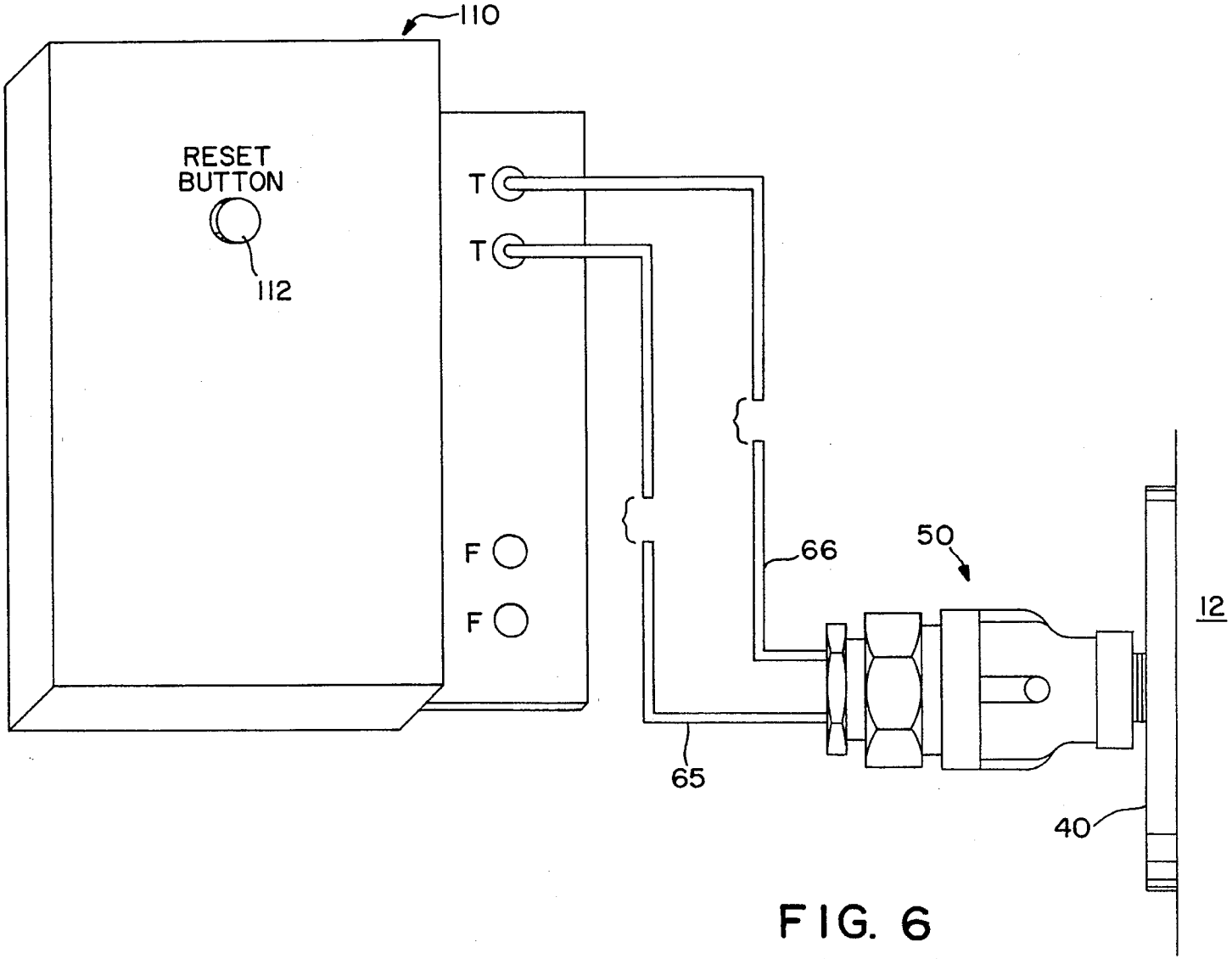
FIG. 6 is a schematic electrical circuit diagram showing a control embodying the invention being employed in one preferred connection arrangement.

In FIG. 6 is shown a flue-draft-malfunction detector and oil burner shut-off control 50 being employed in one preferred connection arrangement. The respective leads 65, 66 are shown connected to a pair of terminals "T" and "T" of an ignition oil burner primary control, for example such as a Honeywell "PROTECTORELAY CONTROL" R8184G having a reset button 112. Thus, the electrically conductive U-bend meltable element 72 (FIGS. 3 and 4) forms a "dumper", i.e. a direct connection between terminals T and T. An optical-type flame sensor (not shown), often called a "Cad Cell" is connected across the other pair of terminals "F" and "F". If a flame fails to ignite in the combustion chamber 12 within about 40 to about 45 seconds after the oil burner has started to blow air and to inject atomized fuel into the combustion chamber, then in the absence of sensed flame, the control 110 will shut off the oil burner and will prevent its restarting operation until someone presses the reset button 112.

If the element 72 becomes melted by occurrence of persisting backflowing hot combustion gases 108 (FIG. 4), then the jumper connection which previously existed across terminals T, T becomes open-circuited, and the primary control 110 becomes disabled for shutting off the oil burner and for preventing pressing of the reset button 112 from restarting the burner to run. Thus, advantageously a home owner upon discovering that the oil burner is not operating and upon finding that pressing of the reset button does not restart continuing normal running operation of the oil burner will be induced to call a mechanic. The mechanic will see that the oil burner was automatically shut down by open-circuiting of the T to T terminal connection due to melting of element 72. The mechanic will recognize that such melting occurred because of draft malfunction and will correct such malfunction. The mechanic will replace the old sleeve component 64 containing the melted U-bend element 72 with a new sleeve component 64 containing an intact U-bend element 72.

Replacement is accompanied by disconnecting leads 65, 66 from terminals T, T and by loosening the compression nut 60 for loosening the compression ring 74 sufficiently for allowing withdrawal of the old sleeve component 64 from the control 50. The new sleeve component 64 is inserted into the control 50; the compression nut 60 is tightened; and the leads 65, 66 of the new sleeve component 64 are connected to terminals T, T. Then, the oil burner is ready to be restarted to run in normal operation.

Figure 7:
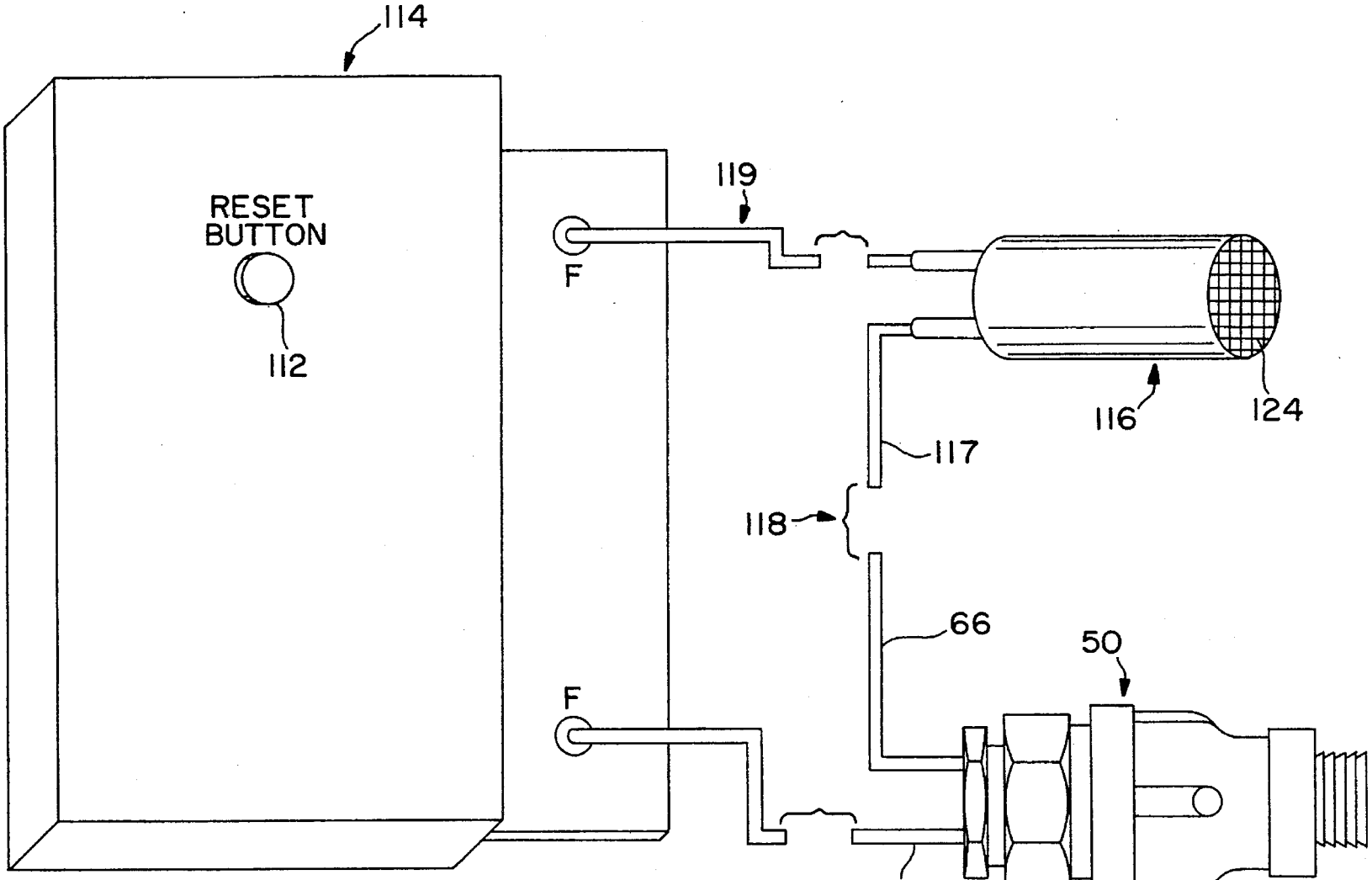
FIG. 7 is a schematic electrical circuit diagram showing a control embodying the invention being employed in another preferred connection arrangement.

FIG. 7 shows the malfunction detector shut-off control 50 in another preferred connection arrangement which may be utilized with an ignition oil burner primary control 114 which is different from the control 110 (FIG. 6). For example the control 114 having a pair of "F" and "F" terminals may be a control unit such as a Honeywell R4184D PROTECTORELAY CONTROL. The control 50 is connected across the pair of terminals F and F in circuit in series with a suitable optical flame sensor 116, for example such as a C554 Cad Cell Flame Sensor. A lead 117 from the sensor 116 is directly connected to a lead 66 of the control 50 as is indicated at 118; another lead 119 of the sensor 116 is connected to a terminal F; and lead 65 is connected to the other terminal F.

The primary control 114, reset button 112 and flame sensor 116 will perform as usual so long as U-bend element 72 (FIGS. 3, 4 and 5) in control 50 remains intact. If this element 72 becomes melted by persisting occurrence of backflowing hot combustion gases 108 (FIG. 4), then the series circuit (including sensor 116 and control 50) connected between terminals F, F becomes interrupted for shutting off the oil burner. A home owner, upon learning that the oil burner is not operating and that pressing the reset button will not restart continuing normal running operation of the burner, will call a mechanic. As described with reference to FIG. 6, the mechanic will correct the draft malfunction and will install a new sleeve component 64 in the control 50 and will connect it across terminals F, F in series with flame sensor 116 so that the oil burner is ready to be restarted to run in continuing normal operation.

Figure 8:
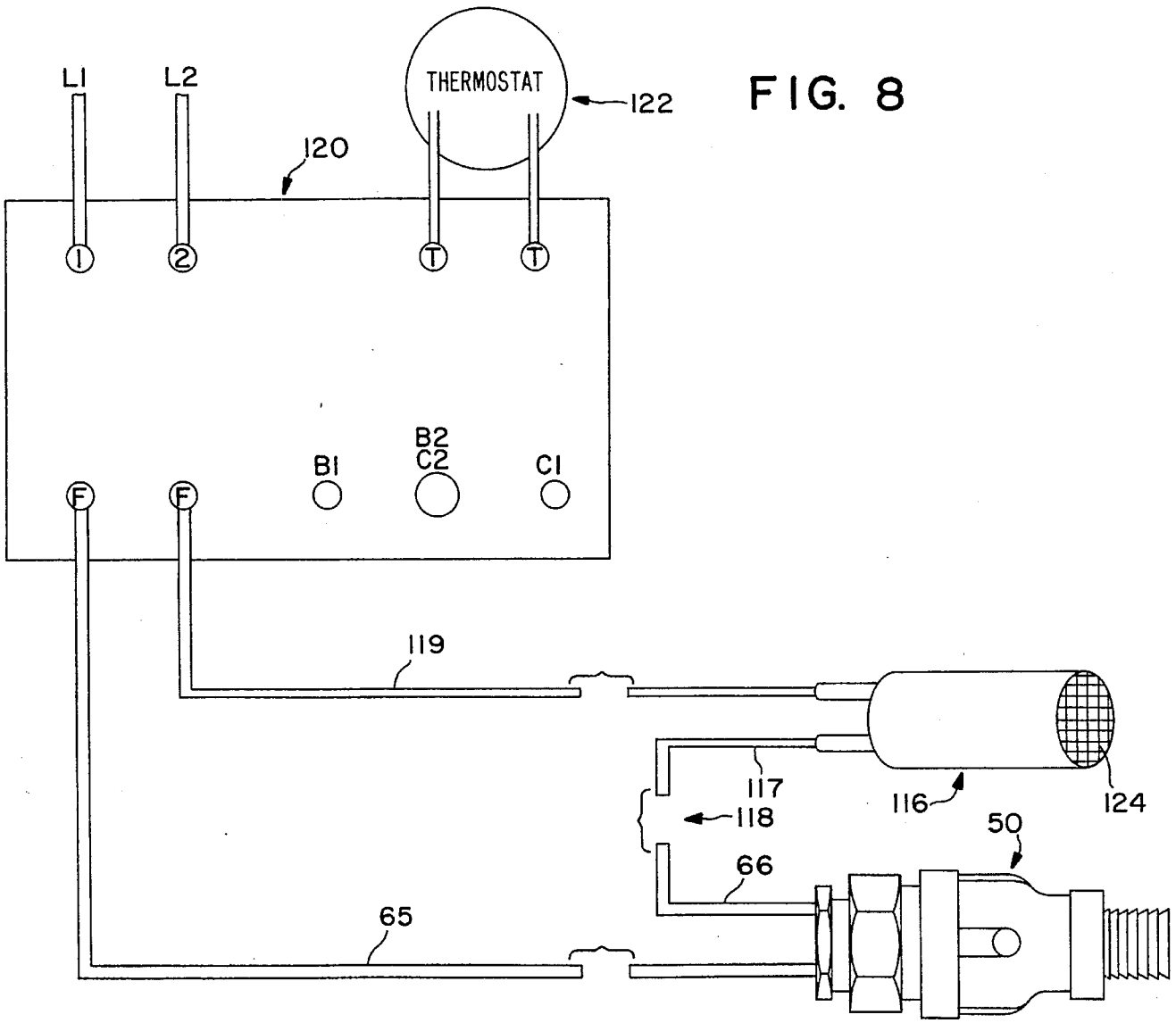
FIG. 8 is a schematic electrical circuit diagram showing a control embodying the invention being employed in a third preferred connection arrangement.

FIG. 8 shows the malfunction detector shut-off control 50 in a third preferred connection arrangement which may be utilized with a combination oil burner primary control and aquastat controller 120, for example such as a Honeywell COMBINATION PROTECTORELAY PRIMARY CONTROL AND AQUASTAT CONTROLLER L8182D. In FIG. 8 the control 120 is shown with its cover removed to reveal its various terminals, but no other internal elements are illustrated. Power lines L1 and L2 (for example at 110 to 120 volts AC) are connected to terminals 1 and 2, with L1 being the "hot" AC line and L2 being the "neutral" AC line. A room temperature sensing thermostat 122 has its leads connected to a pair of T, T terminals. The control 50 is connected across the terminals F and F in series with a flame sensor 116. B1 is a connection terminal for a "hot" lead to the oil burner. C1 is a connection terminal for a "hot" lead to a motor for a circulator pump for circulating heating water. B2, C2 is a terminal for connection of the "neutral" leads to the burner and circulator motor. So long as the meltable element in control 50 is intact, the primary control 120 will provide for normal running operation of the oil burner. Upon melting of this element, which opens the circuit connected between terminals F, F, the oil burner immediately is turned off and cannot be restarted to run in continuing normal operation until this open-circuited element is replaced by an intact element. Thus, as before, a home owner is induced to call a mechanic who will fix the flue draft malfunction and replace the melted element so that the burner can be restarted to run in continuing normal operation.

The Cad Cell Flame Sensor 116 is shown having a grid 124 at the front.

It is noted that a control 120 (FIG. 8) which includes an aquastat must be mounted in a location on an oil burner furnace 10 where the aquastat will fit so as to operate. Usually a control having an aquastat is mounted on the front of the furnace as shown in FIGS. 1 and 2, because a water-temperature sensing bulb (not shown) which is a component of the aquastat is inserted to fit into a well assembly (not shown) in the furnace for sensing temperature of water in the furnace, and such a well assembly conventionally is accessible from the front of a furnace. On the other hand, a primary control such as 110 (FIG. 6) or 114 (FIG. 7) does not include an aquastat and can be mounted in any convenient location on or near the furnace. Thus, FIGS. 1 and 2 which show control 110, 114 or 120 mounted on a furnace front are illustrative of possible arrangements of a flue-draft-malfunction detector and shut-off control 50 in association with a primary furnace control and are not intended as limiting, since the controls 110 and 114 often are mounted in convenient locations other than on a furnace front.

Since other changes and modifications varied to fit particular operating requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. A flue-draft-malfunction detector and shut-off control for an oil burner furnace for automatically stopping operation of the oil burner in event of draft malfunction, said control comprising:

mounting means having a passageway therein with an inlet into said passageway and at least one outlet from said passageway, said mounting means being mountable on a furnace with said inlet being in communication with a combustion chamber within the furnace and with the outlet being in communication with ambient air near the furnace, a meltable, electrically-conductive element having first and second terminals, first and second electrical conductors connected to said first and second terminals, positioning means for said element for holding said element exposed to said passageway, said element being meltable at a temperature in said passageway exceeding a predetermined level due to positive pressure within the combustion chamber causing hot combustion gases to blow from the combustion chamber into said inlet and through said passageway and out from said outlet, and said first and second electrical leads being connectable in a circuit between terminals of a control device of an oil burner for including said element in said circuit to complete said circuit between said terminals of the control device for enabling operation of the oil burner and for preventing operation of the oil burner upon interruption of said circuit by melting of said element.

2. A flue-draft-malfunction detector and shut-off control for an oil burner furnace as claimed in claim 1, wherein:

said mounting means is removably mountable in a peep hole in an inspection door of a furnace, whereby said control may be removed temporarily from the peep hole for observing appearance of a combustion flame within the combustion chamber.

3. A flue-draft-malfunction detector and shut-off control for an oil burner furnace as claimed in claim 2, wherein:

said mounting means has a tubular forward projection which is insertable into the peep hole, and said tubular forward projection defines said inlet into said passageway.

4. A flue-draft-malfunction detector and shut-off control for an oil burner furnace as claimed in claim 3, wherein:

said passageway has a central axis aligned with said inlet, and said element extends across said central axis for exposing said element to hot combustion gases blowing along said passageway toward said element.

5. A flue-draft-malfunction detector and shut-off control for an oil burner furnace as claimed in claim 1, wherein:

said passageway in said mounting means has a central axis, said meltable, electrically-conductive element is U-shaped having a U-bend, and said U-bend of said element is positioned adjacent said axis.

6. A flue-draft-malfunction detector and shut-off control for an oil burner furnace as claimed in claim 5, wherein:

said U-bend is positioned extending across said central axis, and a convex side of said U-bend is faced forward along said central axis toward said inlet of said passageway.

7. A flue-draft-malfunction detector and shut-off control for an oil burner furnace as claimed in claim 6, wherein:

said positioning means is a sleeve having a forward end and a rearward end, said U-shaped, meltable, electrically-conductive element is mounted in said sleeve with its U-bend protruding from the forward end of said sleeve and with said first and second electrical conductors extending from the rearward end of said sleeve, and said sleeve is removable from said mounting means for replacement of said sleeve together with said U-shaped element.

8. A flue-draft malfunction detector and shut-off control for an oil burner furnace as claimed in claim 1, wherein:

said positioning means for said element for holding said element exposed to said passageway are electrically insulative and of low thermal conductivity.

9. A flue-draft-malfunction detector and shut-off control for an oil burner furnace as claimed in claim 1, wherein:

said meltable, electrically-conductive element melts at a temperature above about 350° F., said positioning means for holding said element include a sleeve component, and said sleeve is removably insertable into an end of said mounting means opposite from said inlet.

10. A flue-draft-malfunction detector and shut-off control for an oil burner furnace as claimed in claim 1, wherein:

said element comprises a solder wire.

11. A flue-draft-malfunction detector and shut-off control for an oil burner furnace as claimed in claim 10, wherein:

said solder wire has a composition of about 60% tin and about 40% lead.

12. A flue-draft-malfunction detector and shut-off control for an oil burner furnace as claimed in claim 11, wherein:

said solder wire is rosin-cored and has an outside diameter in a range of about 0.03 of an inch to about 0.05 of an inch.

13. A flue-draft-malfunction detector and shut-off control for an oil burner furnace for automatically stopping operation of the oil burner in event of flue draft malfunction, said control comprising:

a heat-resistant casing having forward and rearward ends, said heat resistant casing having a passageway therein with an inlet into said passageway and at least one outlet from said passageway, said inlet being in said forward end of said casing, mounting means for mounting said casing on a furnace with said inlet being in communication with a combustion chamber within the furnace and with the outlet being in communication with ambient air near the furnace, a meltable, electrically-conductive element having first and second terminals, first and second electrical conductors connected to said first and second terminals, positioning means for said element for holding said element within said casing exposed to said passageway, said element being meltable at a temperature in said passageway exceeding a predetermined level due to positive pressure within the combustion chamber causing hot combustion gases to flow from the combustion chamber into said inlet and through said passageway and out from said outlet, and said first and second electrical conductors extending from said casing.

14. A flue-draft-malfunction detector and shut-off control for an oil burner furnace as claimed in claim 13, wherein:

said casing has a central axis extending through the forward and rearward ends of said casing, there are a plurality of said outlets in said casing, said outlets extend through a wall of said casing, and said outlets are aimed generally radially relative to said central axis of said casing.

15. A flue-draft-malfunction detector and shut-off control for an oil burner furnace as claimed in claim 14, wherein:

said positioning means is a heat-resistant, sleeve having front and back ends, said sleeve is located in the rearward end of said casing, said element is in the front end of said sleeve exposed to said passageway, said element is positioned on said axis at a location generally radially inward from said outlets, and said first and second electrical leads extend out from the rear end of said sleeve.

16. A flue-draft-malfunction detector and shut-off control for an oil burner furnace as claimed in claim 13, wherein:

said positioning means is a heat-resistant sleeve having front and back ends, said meltable, electrically-conductive element is generally U-shaped having U-bend with first and second legs, said legs are held in the front end of said sleeve, said first and second terminals are respective end portions of said first and second legs, said first and second electrical conductors are connected by first and second connectors to the respective end portions of said first and second legs, said first and second connectors are held in said sleeve, said U-bend protrudes from the front end of said sleeve into said passageway, said first and second electrical conductors extend from the back end of said sleeve, and said sleeve is removable from said casing for replacement of said sleeve and said meltable element.

17. A flue-draft-malfunction detector and shut-off control for an oil burner furnace as claimed in claim 16, wherein:

said element is a solder wire bent into a generally U-shaped configuration.

18. A flue-draft-malfunction detector and shut-off control for an oil burner furnace as claimed in claim 13, wherein:

said positioning means enable said element to be removed from said casing for being replaced by a new element.

19. A flue-draft-malfunction detector and shut-off control for an oil burner furnace for automatically stopping operation of the oil burner in event of flue draft malfunction, said control comprising:

a heat-resistant casing having forward and rearward ends, said heat resistant casing having a passageway therein with an inlet into said passageway and at least one outlet from said passageway, said inlet being in mounting means in said forward end of said casing, said mounting means being mountable on inspection means of the furnace having a view port for mounting said inlet in communication through said view port with a combustion chamber within the furnace and with the outlet being in communication with ambient air near the furnace, a meltable, electrically-conductive element having first and second terminals, first and second electrical conductors connected to said first and second terminals, positioning means for said element for holding said element exposed to said passageway, said element being meltable at a temperature in said passageway exceeding a predetermined level due to persisting positive pressure within the combustion chamber causing hot combustion gases to flow from the combustion chamber into said inlet and through said passageway and out from said outlet, and said first and second electrical conductors extending from said casing.

20. A flue-draft-malfunction detector and shut-off control for an oil burner furnace as claimed in claim 19, wherein:

said rearward end of said casing includes means for removably inserting said positioning means into the rearward end of said casing with said meltable element exposed to said passageway, and said electrical conductors extend from a rearward end of said positioning means, whereby said positioning means together with said meltable element and said electrical conductors are all removed together from said casing by removal of said positioning means from the rearward end of said casing.

* * * * *